US006993793B1

(12) United States Patent
Li

(10) Patent No.: US 6,993,793 B1
(45) Date of Patent: Feb. 7, 2006

(54) GRASPING-ENHANCED INDUSTRIAL GLOVE

(75) Inventor: Peng-Hui Li, Kaohsiung (TW)

(73) Assignee: Family Glove Co., LTD, Kaohsiung Hsien (TW)

( * ) Notice: Subject to any disclaimer, the term of this patent is extended or adjusted under 35 U.S.C. 154(b) by 0 days.

(21) Appl. No.: 10/936,379

(22) Filed: Sep. 9, 2004

(51) Int. Cl.
*A41D 19/00* (2006.01)

(52) U.S. Cl. ..... 2/161.8

(58) Field of Classification Search ..... 2/158, 2/159, 161.3, 161.6, 161.8, 163, 168, 16
See application file for complete search history.

(56) References Cited

U.S. PATENT DOCUMENTS 4,359,783 A * 11/1982 Andrews ..... 2/161.8
4,526,828 A * 7/1985 Fogt et al. ..... 442/19
4,589,940 A * 5/1986 Johnson ..... 156/78
4,779,290 A * 10/1988 Welch et al. ..... 2/161.6
5,598,582 A * 2/1997 Andrews et al. ..... 2/16
6,185,747 B1 * 2/2001 Hughes ..... 2/161.6

* cited by examiner

*Primary Examiner*—Danny Worrell

(57) ABSTRACT

A grasping-enhanced industrial glove comprises an inner cotton layer having a finger portion; a sheet of net layer being seamed to the finger portion; the net layer being adhered with thick rubber material by placing the inner cotton layer in a hand mold and soaking in a rubber material; the rubber material of the net layer having a width of about 20% to 30% of the net layer; and an outer rubber layer having a texture portion. By above structure, the glove has a strong grasping force. The net layer can be extended to the fingernails from the inner portion of the fingers. The net layer is made of cotton material or metal material. The material of the outer rubber layer is selected from one of Nitrile-Butadiene Rubber, Nature Rubber, Polyvinylchloride and Polyurethane.

8 Claims, 6 Drawing Sheets

GRASPING-ENHANCED INDUSTRIAL GLOVE

FIELD OF THE INVENTION

The present invention relates to gloves, and particular to a grasping-enhanced industrial glove which is used in industries necessary to contact with oils or heavy objects, such as fishery, or assembly or maintenance of vehicles.

BACKGROUND OF THE INVENTION

The industrial rubber gloves, such as fishery gloves, or vehicle used gloves, mechanic used gloves, have the functions of water-proof, oil-proof and firmness. In manufacturing it is formed by a handle mold which is soaked in natural or composite rubber or emulsion. The material suitable may be for example high density Nitrile Butadiene—Rubber, which can achieve above mentioned object.

Referring to FIG. 1, a prior art industrial glove is illustrated. It is illustrated that the inner part of the glove is coarse, which is unsuitable to the feeling of the users. In the manufacturing process, a hand mold is covered with a cotton material to seam with an inner layer 91, as shown in FIG. 2. Then, the hand mold is soaked in rubber solution so that the rubber material is adhered to a surface of the inner cotton layer. Then the hand mold is taken out for heating. After the rubber is dried and shaped, an industrial used glove is acquired. The glove has the advantage of not to rub the skin of the hand.

The glove 90 in FIG. 1 has an inner cotton layer 91 and an outer rubber layer 92. To have a preferred grasping force and slide-proof ability, the surface of the palm portion of the glove is machined to increase the coarseness. Thus, it is convenient in grasping.

However, the industrial glove has some defects. For example, if the glove is used to grasp a heavy object, it is possible that the coarseness is insufficient so that the object slides out, especially in grasping coarse net or fishes in fishery, or heaving objects in vehicle plant. It is often that finger portions of the glove are worn so as not to be used. Thereby, it is the coverage of the present invention to increase the thickness and coarseness of the glove.

SUMMARY OF THE INVENTION

Accordingly, the primary object of the present invention is to provide a grasping-enhanced industrial glove, wherein textures are added to the glove so as to increase the grasping ability of the glove and thus to prolong the lifetime of the glove, To achieve above objects, the present invention provides a grasping-enhanced industrial glove which comprises an inner cotton layer having a finger portion; a sheet of net layer being seamed to the finger portion; the net layer being adhered with thick rubber material by placing the inner cotton layer in a hand mold and soaking in a rubber material; the rubber material of the net layer having a width of about 20% to 30% of the net layer; and an outer rubber layer having a texture portion. By above structure, the glove has a strong grasping force. The net layer can be extended to the fingernails from the inner portion of the fingers. The net layer is made of cotton material or metal material. The material of the outer rubber layer 12 is selected from one of Nitrile-Butadiene Rubber, Nature Rubber, Polyvinylchloride and Polyurethane.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
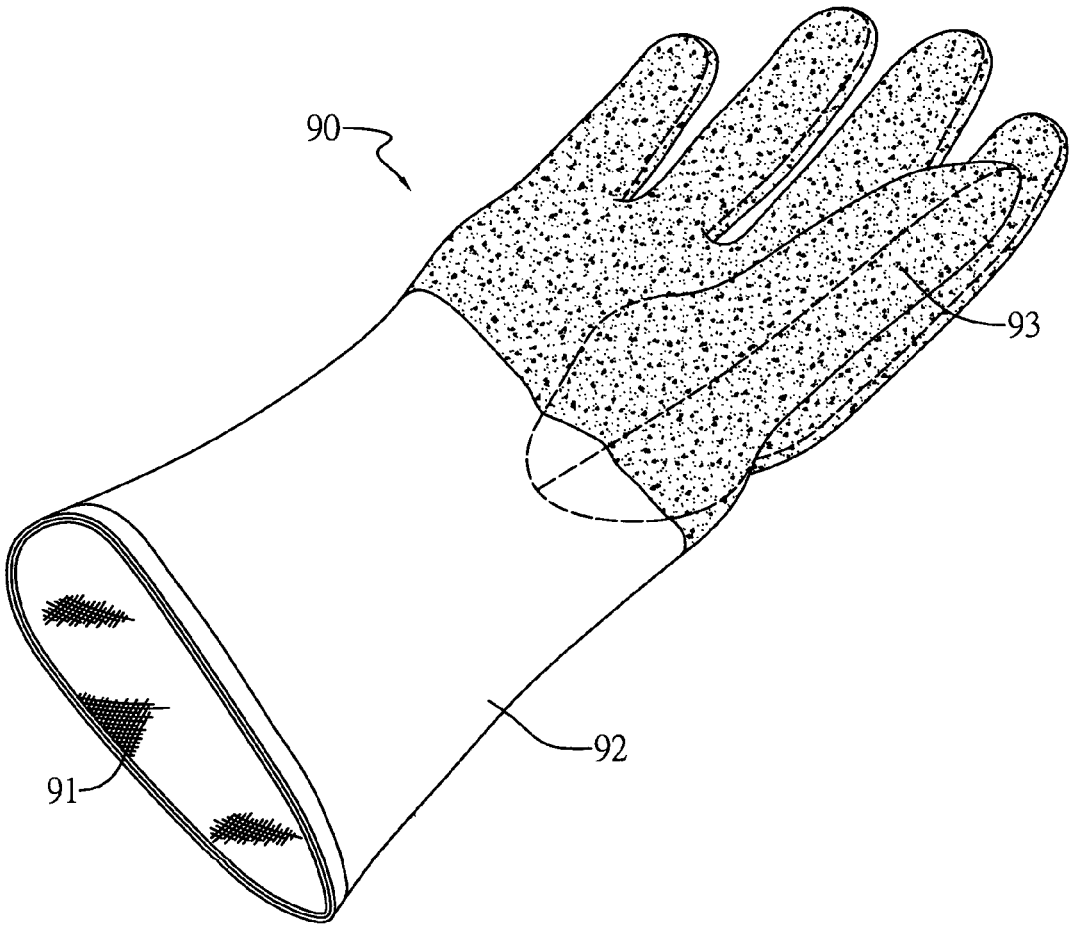
FIG. 1 is a perspective view of a prior art industrial glove.
Figure 2:
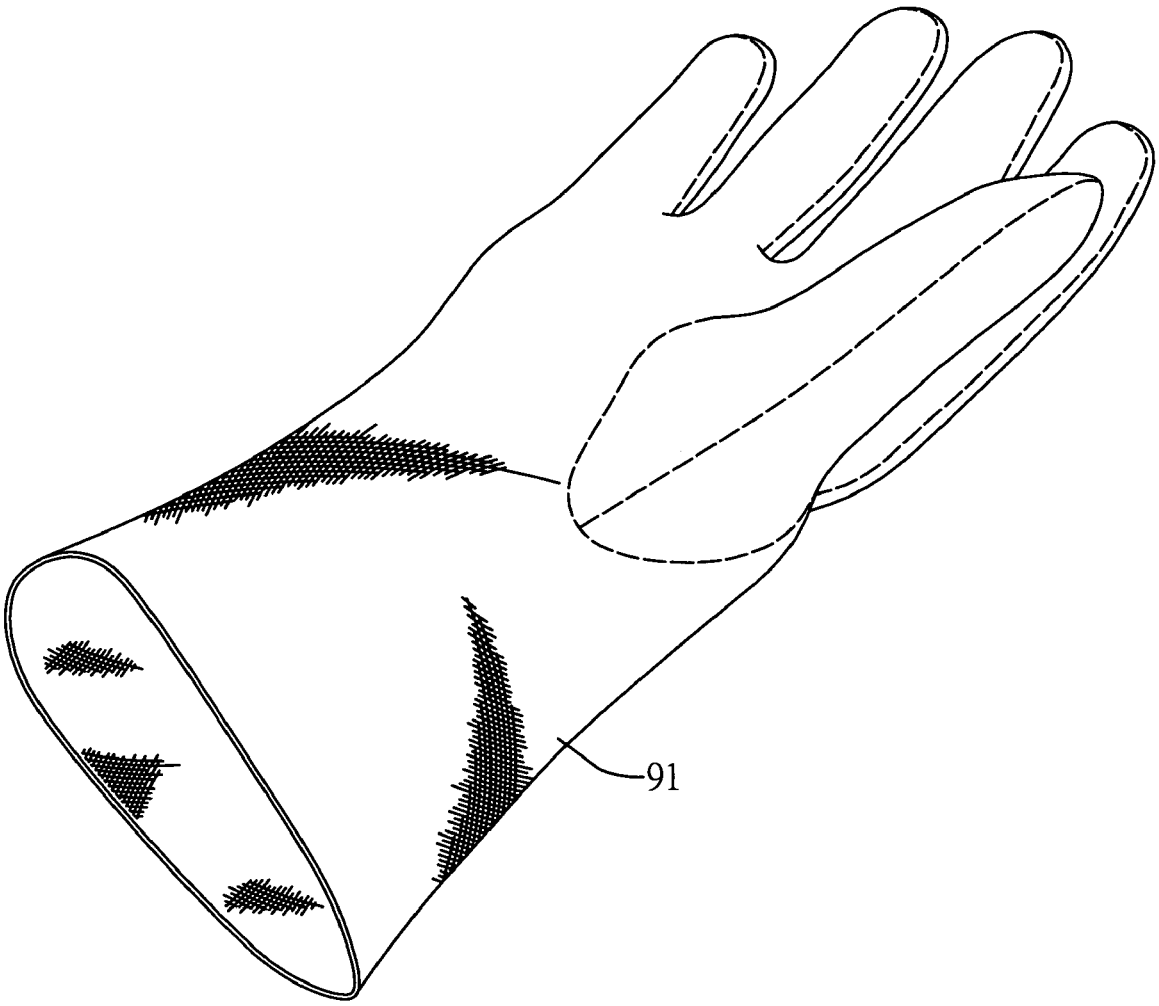
FIG. 2 is a schematic view showing the inner cotton layer of the industrial glove illustrated in FIG. 1.
Figure 3:
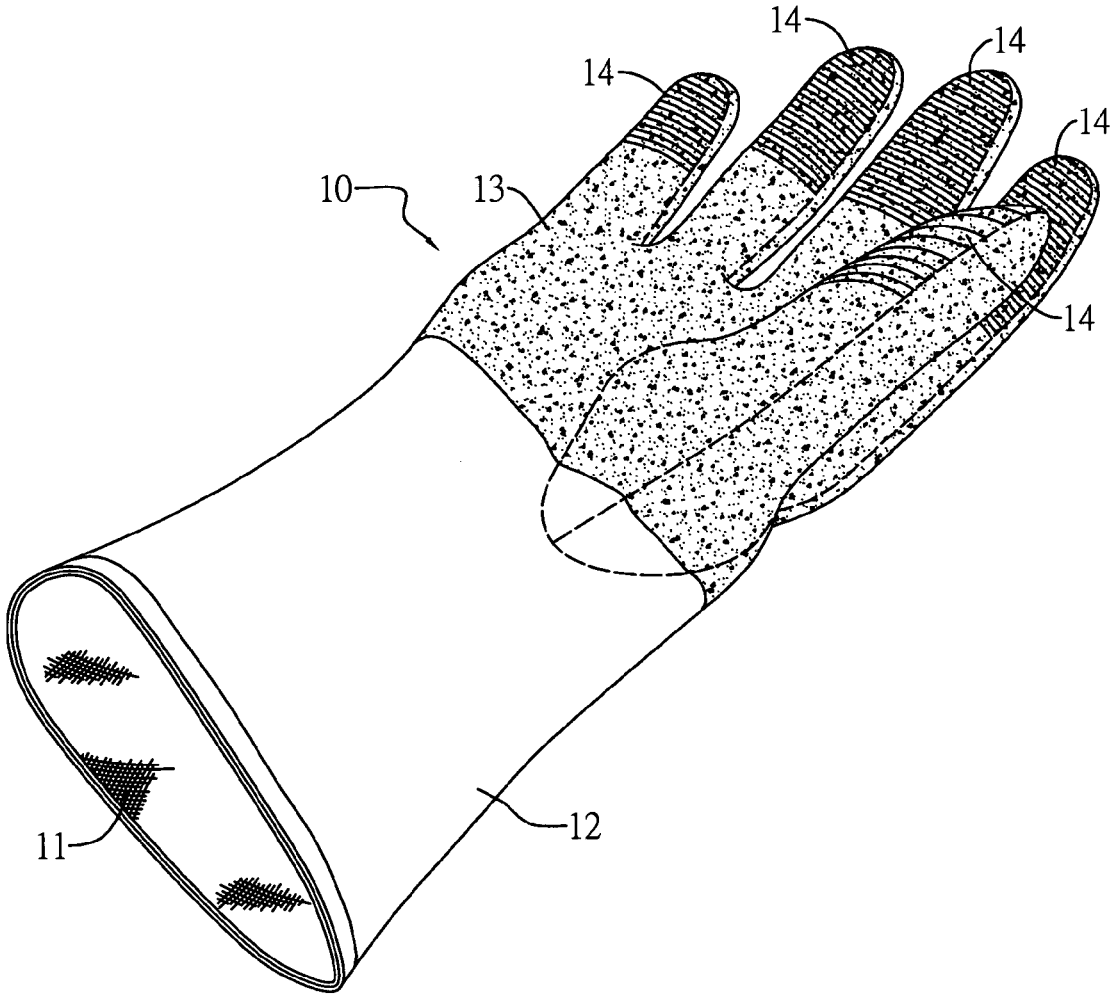
FIG. 3 is a perspective view of the industrial glove of the present invention.
Figure 4:
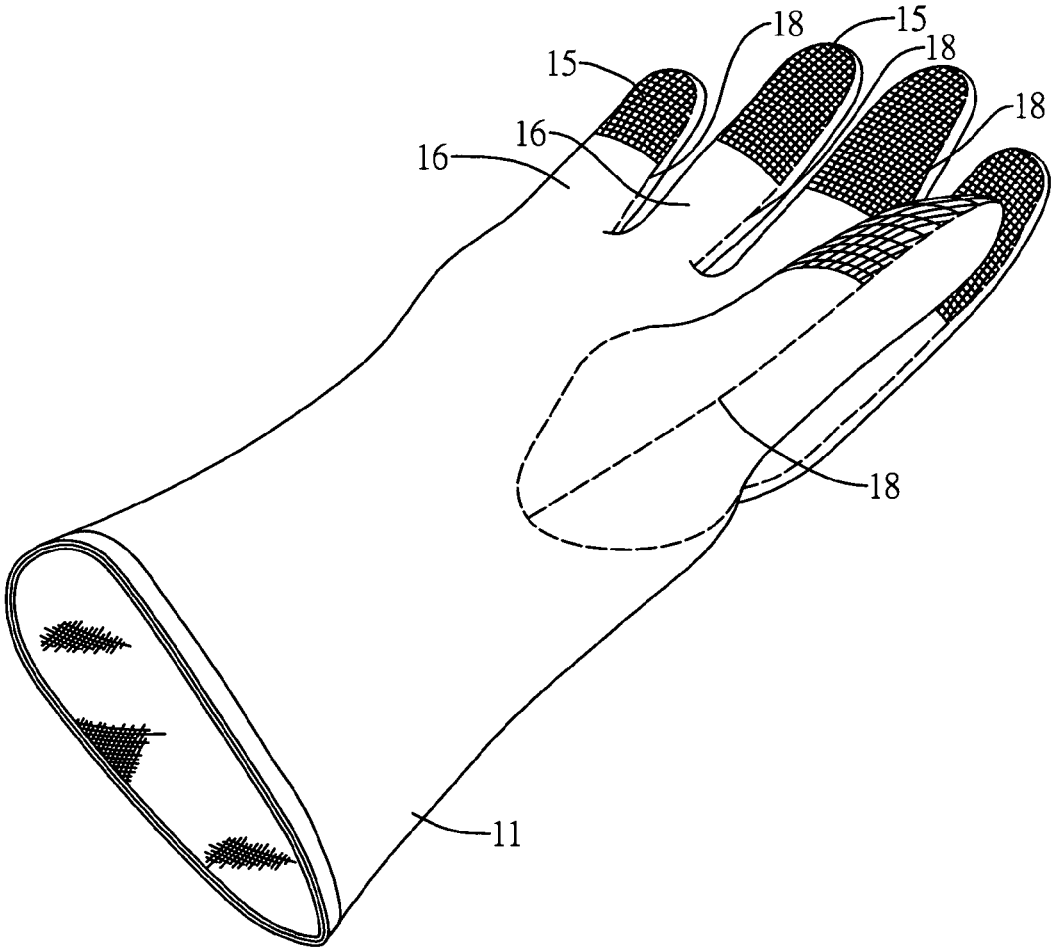
FIG. 4 is a perspective view of the inner cotton layer of the present invention.
Figure 5:
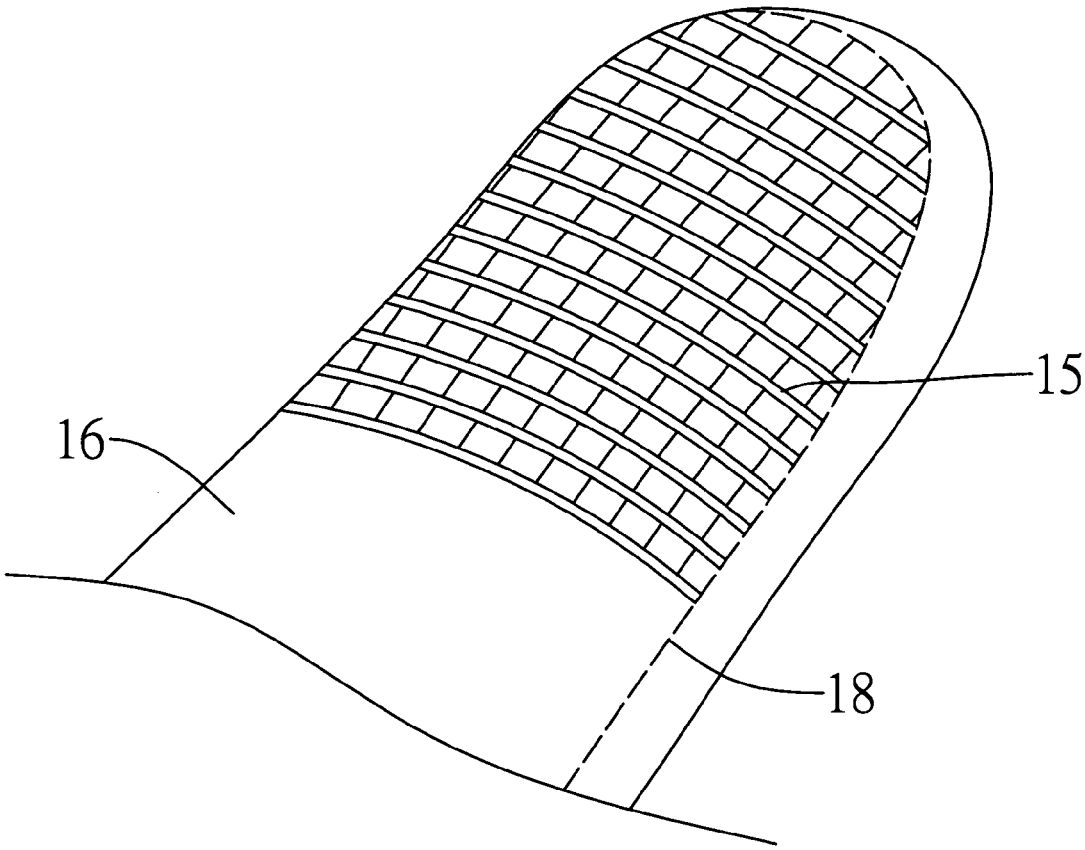
FIG. 5 is an enlarged view of part A in FIG. 4.

Referring to FIG. 1, the industrial glove 10 of the present invention is illustrated. The glove 10 comprises the following elements. An inner cotton layer 11 has a finger portion 16. A sheet of net layer 15 is seamed to the finger portion 16, as shown in FIGS. 4 and 5. Two sides of each finger of the finger portion 16 are seamed by a seaming line 18, as shown in FIG. 5. The net layer 15 is adhered with thick rubber material by placing the inner cotton layer 11 into a hand mold and soaking the inner cotton layer 11 into rubber liquid.

The net layer 15 is seamed with the seaming line 18. The rubber material of the net layer 15 has a width of about 20% to 30% of the net layer 15.

Figure 6:
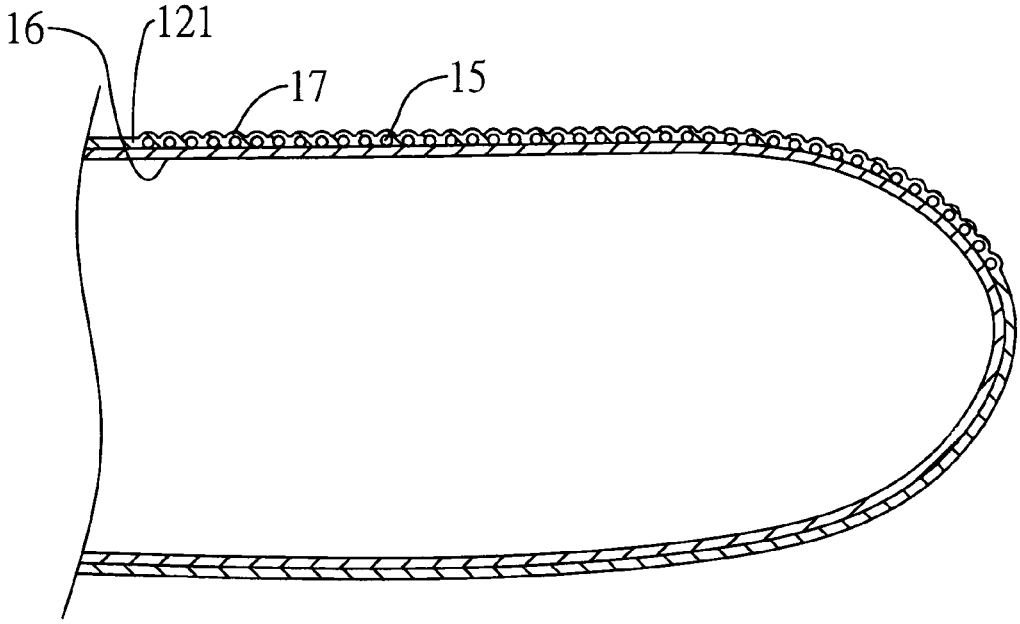
FIG. 6 is a partial cross section view of the present invention.

An outer rubber layer 12 has a base layer 121. A plurality of protrusions 17 are formed on the base layer 121 due to the rubber material on the net layer 15, as shown in FIG. 6 so as to increase the grasping force. The outer rubber layer 12 has a palm portion 13 and a texture portion 14 on the finger portion of the outer rubber layer 12. The palm portion 13 is coarsened. The texture portion 14 increases a thickness of the finger portion of the outer rubber layer 12 and thus increases the grasping force, as shown in FIG. 6. Basically, the texture portion has transversal texture. However, the textures in the texture portion 14 may be fabricated according to the lattices of the net layer 15 or other shapes, such as wavelike shapes, round shapes, etc.

The texture portion 14 covers from the fingertips to be between the first joints and second joints of the finger so as that the texture will not affect the action of the fingers as the fingers bends.

In one embodiment of the present invention, the net layer 15 is made with cotton material as the inner cotton layer 11.

In another embodiment of the present invention, the net layer 15 can be made of slender metal wires so as to enhance the structure of the net layer without the problem of wearing.

In the present invention, the net layer 15 can be extended to the fingernails from the inner portion of the fingers. Furthermore, in the present invention, the net layer 15 is not limited on the finger portions. The net layer 15 can be extended to other portion of the glove 10.

In the present invention, the material of the outer rubber layer 12 is selected from one of N (Nitrile-Butadiene Rubber), NB (Nature Rubber, NB), PVC (Polyvinylchloride) and PU (Polyurethane), etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A grasping-enhanced industrial glove comprising:

an inner cotton layer having a finger portion; a sheet of net layer being seamed to the finger portion; and other portion of the inner cotton layer being not covered by the net layer; the net layer being adhered with thick rubber material by placing the inner cotton layer in a hand mold and soaking in a rubber material; and an outer rubber layer having a texture portion at the finger portion; and other portion of the outer rubber layer being not covered by the texture portion; the outer rubber layer formed separatly from the inner cotton layer and enclosing the inner cotton layer;

whereby, by above structure, the glove has a strong grasping force.

2. The grasping-enhanced industrial glove as claimed in claim 1, wherein the outer rubber layer having a base layer; a plurality of protrusions are formed on the base layer due to the rubber material on the net layer so as to increasing the grasping force; the outer rubber layer has a palm portion and the palm portion is coarsened.

3. The grasping-enhanced industrial glove as claimed in claim 1, wherein the texture portion has transversal texture.

4. The grasping-enhanced industrial glove as claimed in claim 1, wherein the net layer is extended to the fingernails from the inner portion of the fingers.

5. The grasping-enhanced industrial glove as claimed in claim 1, wherein the net layer is made of cotton material.

6. The grasping-enhanced industrial glove as claimed in claim 1, wherein the net layer is made of metal material.

7. The grasping-enhanced industrial glove as claimed in claim 1, wherein the texture portion is in a finger portion of the outer rubber layer.

8. The grasping-enhanced industrial glove as claimed in claim 1, wherein the material of the outer rubber layer is selected from one of Nitrile-Butadiene Rubber, Nature Rubber, Polyvinylchloride and Polyurethane.

* * * * *